US011396689B2

(12) United States Patent
Bae

(10) Patent No.: US 11,396,689 B2
(45) Date of Patent: Jul. 26, 2022

(54) STEEL MATERIAL FOR LOW YIELD RATIO, HIGH-STRENGTH STEEL PIPE HAVING EXCELLENT LOW-TEMPERATURE TOUGHNESS, AND MANUFACTURING METHOD THEREFOR

(71) Applicant: POSCO, Nam-gu Pohang-si (KR)

(72) Inventor: Jin-Ho Bae, Gwangyang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 16/957,136

(22) PCT Filed: Dec. 18, 2018

(86) PCT No.: PCT/KR2018/016108
§ 371 (c)(1),
(2) Date: Jun. 23, 2020

(87) PCT Pub. No.: WO2019/124926
PCT Pub. Date: Jun. 27, 2019

(65) Prior Publication Data

US 2020/0392608 A1 Dec. 17, 2020

(30) Foreign Application Priority Data

Dec. 24, 2017 (KR) ..... 10-2017-0178927

(51) Int. Cl.

| | |
|---|---|
| ***C22C 38/44*** | (2006.01) |
| ***C21D 8/02*** | (2006.01) |
| ***C21D 9/00*** | (2006.01) |
| ***C22C 38/00*** | (2006.01) |
| ***C22C 38/04*** | (2006.01) |
| ***C22C 38/06*** | (2006.01) |
| ***C22C 38/42*** | (2006.01) |
| ***C22C 38/46*** | (2006.01) |
| ***C22C 38/48*** | (2006.01) |

(52) U.S. Cl.
CPC ..... *C22C 38/44* (2013.01); *C21D 8/0226* (2013.01); *C21D 9/0081* (2013.01); *C22C 38/001* (2013.01); *C22C 38/04* (2013.01); *C22C 38/06* (2013.01); *C22C 38/42* (2013.01); *C22C 38/46* (2013.01); *C22C 38/48* (2013.01); *C21D 2211/001* (2013.01); *C21D 2211/002* (2013.01); *C21D 2211/008* (2013.01)

(58) Field of Classification Search
CPC ..... C21D 2211/001; C21D 2211/002; C21D 2211/008; C21D 6/00; C21D 6/02; C21D 8/0205; C22C 38/00
USPC ..... 420/109
See application file for complete search history.

(56) References Cited

U.S. PATENT DOCUMENTS

| | | | |
|---|---|---|---|
| 2006/0151074 | A1 | 7/2006 | Ishikawa et al. |
| 2007/0125462 | A1 | 6/2007 | Asahi et al. |
| 2014/0158259 | A1 | 6/2014 | Ahn et al. |
| 2015/0090370 | A1 | 4/2015 | Shimamura et al. |
| 2016/0122844 | A1 | 5/2016 | Liu et al. |
| 2016/0153063 | A1 | 6/2016 | Goto et al. |
| 2019/0233926 | A1* | 8/2019 | Sano ..... C22C 38/001 |
| 2020/0040435 | A1 | 2/2020 | Nakano et al. |

FOREIGN PATENT DOCUMENTS

| | | | | |
|---|---|---|---|---|
| CN | 102560284 | A | * | 7/2012 |
| CN | 103343300 | A | | 10/2013 |
| EA | 013145 | B1 | | 2/2010 |
| JP | 2010-077492 | A | | 4/2010 |
| JP | 5292784 | B2 | | 6/2013 |
| JP | 6187730 | B1 | | 8/2017 |
| JP | 2016-524653 | A | | 8/2020 |
| KR | 10-0723156 | A | | 5/2007 |
| KR | 10-0833033 | B1 | | 5/2008 |
| KR | 10-1044161 | B1 | | 6/2011 |
| KR | 10-2012-0083934 | A | | 7/2012 |
| KR | 10-2014-0083540 | A | | 7/2014 |
| KR | 10-2015-0002958 | A | | 1/2015 |
| KR | 10-2015-0074706 | A | | 7/2015 |
| KR | 10-2015-0074968 | A | | 7/2015 |
| KR | 10-2015-0075292 | A | | 7/2015 |
| KR | 10-2016-0025624 | A | | 3/2016 |
| KR | 10-2017-0075918 | A | | 7/2017 |
| RU | 2331698 | C2 | | 8/2008 |
| RU | 2623551 | C2 | | 6/2017 |

(Continued)

OTHER PUBLICATIONS

NPL: on-line English translation of CN-102560284-A ,Jul. 2012 (Year: 2012).*

(Continued)

*Primary Examiner* — Jie Yang
(74) *Attorney, Agent, or Firm* — Morgan, Lewis & Bockius LLP

(57) ABSTRACT

A steel material for a low yield ratio, high-strength steel pipe having excellent low-temperature toughness according to an aspect of the present invention comprises, by weight %, 0.03-0.065% of C, 0.05-0.3% of Si, 1.7-2.2% of Mn, 0.01-0.04% of Al, 0.005-0.025% of Ti, 0.008% or less of N, 0.08-0.12% of Nb, 0.02% or less of P, 0.002% or less of S, 0.05-0.3% of Cr, 0.4-0.9% of Ni, 0.3-0.5% of Mo, 0.05-0.3% of Cu, 0.0005-0.006% of Ca, 0.001-0.04% of V, and the balance of Fe and inevitable impurities, wherein a number of deposits having an average diameter of 20 nm or less per unit area in a cross section of the steel material may be $6.5*10^9/mm^2$ or greater.

15 Claims, No Drawings

(56) References Cited

FOREIGN PATENT DOCUMENTS

| | | | |
|---|---|---|---|
| WO | 2008/078917 | A1 | 7/2008 |
| WO | 2011/042936 | A1 | 4/2011 |

OTHER PUBLICATIONS

International Search Report and Written Opinion issued in International Application No. PCT/KR2018/016108, dated Mar. 19, 2019.
Russian Office Action dated Dec. 2, 2020 issued in Russian Patent Application No. 2020124394.
Extended European Search Report dated Jan. 29, 2021 issued in European Patent Application No. 18891198.6.

* cited by examiner

STEEL MATERIAL FOR LOW YIELD RATIO, HIGH-STRENGTH STEEL PIPE HAVING EXCELLENT LOW-TEMPERATURE TOUGHNESS, AND MANUFACTURING METHOD THEREFOR

CROSS-REFERENCE OF RELATED APPLICATIONS

This application is the U.S. National Phase under 35 U.S.C. § 371 of International Application No. PCT/KR2018/016108 filed on Dec. 18, 2018, which claims the benefit of Korean Patent Application No. 10-2017-0178927 filed Dec. 24, 2017. The entire disclosures of each are incorporated by reference herein.

TECHNICAL FIELD

The present disclosure relates to a steel material for low yield ratio, high-strength steel pipe having excellent low-temperature toughness and a manufacturing method therefor, and more particularly, to a steel material for a high-strength steel pipe having excellent low temperature toughness and low yield ratio so as to be particularly suitable as a material for building, line pipes, and offshore construction, and a manufacturing method therefor.

BACKGROUND ART

Demand for high-strength API steel has increased as a mining depth of oil wells increases and a mining and transportation environment becomes harsher. In addition, as oil fields have been developed mainly in cold areas such as Siberia and Alaska with poor climatic conditions, projects to transport rich gas resources of oil fields to consumption areas through line pipes are currently in progress. In order to increase transportation efficiency in using steel pipes for transportation of crude oil or gas, transportation pressure is increased, and recently, the transportation pressure has reached 120 atm.

Steel materials which are commonly thick plate materials and may ensure both low temperature fracture toughness and yield ratio characteristics are mainly applied to the transportation steel pipes in consideration of durability for an extremely low temperature environment and deformation of the ground, as well as high pressure of transported gases. In particular, in the case of a thick steel material having a thickness of 20 mm or greater, as the thickness of the steel material increases, a rolling reduction is insufficient during hot rolling and it is difficult to secure a sufficient cooling rate. As a result, ferrite crystal grains become coarse and low-temperature toughness deteriorates due to segregation at a center part. Therefore, guaranteeing high strength, low temperature toughness, and low yield ratio of steel materials used to manufacture such steel pipes for transportation is a major task currently in the industry.

With regard to steel materials used to manufacture steel pipes for transportation, many studies have been made in the related art to realize excellent DWTT shear area. Patent document 1 proposes manufacturing conditions in which a slab is extracted in a temperature range of 1000 to 1150° C. and rolled at a temperature of Ar3 or higher, and then cooling starts at a temperature of Ar3 or lower. In particular, the cooling starting temperature is limited to Ar3-50° C. to Ar3, and a cooling termination temperature is limited to 300 to 550° C. Through the limitations of the manufacturing conditions, Patent document 1 realizes a transition temperature of −20 to −30° C. that satisfies a DWTT shear area of 85% or greater by implementing a dual phase structure including ferrite having an average particle size of 5 μm, and an area fraction of 50 to 80% and bainite having an aspect ratio of 6 or less. However, with such an abnormal structure alone, it is not possible to secure a strength characteristic that a yield strength of a steel material, in particular, a yield strength in a 30° inclined direction 540 regarding a rolling direction having the lowest value among yield strengths of steel materials is 540 MPa or greater.

(Patent document 1) Japanese Laid-open Publication No. 2010-077492 (published on Apr. 8, 2010)

DISCLOSURE

Technical Problem

An aspect of the present disclosure is to provide a steel material for a low yield ratio, high-strength steel pipe having excellent low-temperature toughness, and a manufacturing method therefor.

The technical problem of the present disclosure is not limited to the above. Those skilled in the art will have no difficulty in understanding the additional technical problem of the present disclosure from the general contents of this specification.

Technical Solution

According to an aspect of the present disclosure, a steel material for a low yield ratio, high-strength steel having excellent low-temperature toughness includes, by wt %, 0.03 to 0.065% of C, 0.05 to 0.3% of Si, 1.7 to 2.2% of Mn, 0.01 to 0.04% of Al, 0.005 to 0.025% of Ti, 0.008% or less of N, 0.08 to 0.12% of Nb, 0.02% or less of P, 0.002% or less of S, 0.05 to 0.3% of Cr, 0.4 to 0.9% of Ni, 0.3 to 0.5% of Mo, 0.05 to 0.3% of Cu, 0.0005 to 0.006% of Ca, 0.001 to 0.04% of V, and a balance of Fe and inevitable impurities, wherein the number of precipitates having an average diameter of 20 nm or less per unit area in a cross section of the steel material may be $6.5*10^9/mm^2$ or greater.

The precipitates may include TiC, NbC and (Ti, Nb)C precipitates.

The steel material may satisfy Equation 1 below:

$$0.17 \le [\{Ti-0.8*(48/14)N\}/48+\{Nb-0.8*(93/14)N\}/93]/(C/12) \le 0.25 \quad \text{[Equation 1]}$$

C, Ti, Nb and N in Equation 1 refer to contents of C, Ti, Nb and N, respectively.

The steel material may satisfy Equation 2 below:

$$2 \le Cr+3*Mo+2*Ni \le 2.7 \quad \text{[Equation 2]}$$

Cr, Mo and Ni in Equation 2 refer to contents of Cr, Mo and Ni, respectively.

The steel material may include acicular ferrite, bainitic ferrite, granular bainite, and island martensite as a microstructure.

The acicular ferrite may be included by 80 to 90%, the bainitic ferrite may be included by 4 to 12%, the granular bainite may be included by 6% or less, and the martensite-austenite (MA) may be included by 5% or less, by an area fraction.

An average effective grain size of the acicular ferrite may be 15 μm or less, the average effective grain size of the bainitic ferrite may be 20 μm or less, the average effective grain size of the granular bainite may be 20 μm or less, and the average effective grain size of the martensite-austenite (MA) may be 3 μm or less.

The steel material may satisfy Equation 3 below.

$$100*(P+10*S)\leq 2.4 \quad \text{[Equation 3]}$$

P and S in Equation 3 refer to contents of P and S, respectively.

An yield strength of the steel material in a 30° inclined direction with reference to a rolling direction of the steel material may be 540 MPa or greater, and a tensile strength of the steel material may be 670 MPa or greater.

An yield ratio of the steel material may be less than 85% and an elongation percentage of the steel material may be 39% or greater.

The steel material may have a Charpy impact energy of 190 J or greater at −60° C., and a lowest temperature satisfying drop weight tear test (DWTT) shear area of 85% or greater may be −18° C. or lower.

A thickness of the steel material may be 23 mm or greater.

According to another aspect of the present disclosure, a steel material for low yield ratio, high-strength steel having excellent low-temperature toughness may be manufactured by: reheating a slab including, by wt %, 0.03 to 0.065% of C, 0.05 to 0.3% of Si, 1.7 to 2.2% of Mn, 0.01 to 0.04% of Al, 0.005 to 0.025% of Ti, 0.008% or less of N, 0.08 to 0.12% of Nb, 0.02% or less of P, 0.002% or less of S, 0.05 to 0.3% of Cr, 0.4 to 0.9% of Ni, 0.3 to 0.5% of Mo, 0.05 to 0.3% of Cu, 0.0005 to 0.006% of Ca, 0.001 to 0.04% of V, and the balance of Fe and inevitable impurities, and satisfying Equation 1 below in a temperature range of 1080 to 1180° C.; maintaining the reheated slab at a temperature of 1140° C. or higher for 45 minutes and extracting the slab; primarily rolling the extracted slab at a rolling termination temperature of 980 to 1100° C.; primarily cooling the primarily rolled steel material to a non-recrystallization region temperature range at a cooling rate of 20 to 60° C./s; secondarily rolling the primarily cooled steel material primarily cooled at the non-recrystallization region temperature; secondarily cooling the second rolled steel material at a cooling rate of 10 to 40° C./s; and coiling the second cooled steel material in a temperature range of 420 to 540° C. to manufacture the same.

$$0.17\leq[\{Ti-0.8*(48/14)N\}/48+\{Nb-0.8*(93/14)N\}/93]/(C/12)\leq 0.25 \quad \text{[Equation 1]}$$

C, Ti, Nb, and N in Equation 1 refer to contents of C, Ti, Nb and N, respectively.

The slab may satisfy Equation 2 below:

$$2\leq Cr+3*Mo+2*Ni\leq 2.7 \quad \text{[Equation 2]}$$

Cr, Mo, and Ni in Equation 2 refer to contents of Cr, Mo and Ni, respectively.

The slab may satisfy Equation 3 below:

$$100*(P+10*S)\leq 2.4 \quad \text{[Equation 3]}$$

P and S in Equation 3 refer to contents of P and S, respectively.

The non-recrystallization region temperature may be a temperature range of 910 to 970° C.

A reduction ratio of the second rolling may be 75 to 85%.

A termination temperature of the second rolling may be Ar3+70° C. to Ar3+110° C.

Advantageous Effects

According to exemplary embodiments in the present disclosure, by controlling the alloy composition and manufacturing process optimally, the steel material for a high-strength steel pipe which ensures the yield strength of 540 MPa or greater in 30° inclined direction with reference to the rolling direction in which the yield strength of the steel material has the lowest value and the manufacturing method therefor may be provided.

In addition, according to an aspect of the present disclosure, the steel material for low yield ratio, high-strength steel pipe having excellent low-temperature toughness, which satisfies a tensile strength of 670 MPa or more, 190 J or more Charpy impact energy at −60° C., the lowest temperature that satisfies 85% or more of the DWTT shear area of −18° C. or lower, the yield ratio less than 85%, and the elongation percentage of 39% or greater, and the manufacturing method therefor may be provided.

BEST MODE

The present disclosure relates to a steel material for a low-yield ratio, high-strength steel pipe having excellent low-temperature toughness and a manufacturing method therefor, and hereinafter, exemplary embodiments in the present disclosure will be described. The exemplary embodiments in the present disclosure may be modified in various forms and the scope of the present disclosure should not be construed as being limited to the exemplary embodiments described below. These exemplary embodiments are provided to explain the present disclosure in more detail to those of ordinary skill in the art.

Hereinafter, a steel composition of the present disclosure will be described in detail. Hereinafter, % is based on a weight representing the content of each element, unless otherwise specified.

A steel material for a low yield ratio, high-strength steel having excellent low-temperature toughness according to an aspect of the present disclosure may include, by wt %, 0.03 to 0.065% of C, 0.05 to 0.3% of Si, 1.7 to 2.2% of Mn, 0.01 to 0.04% of Al, 0.005 to 0.025% of Ti, 0.008% or less of N, 0.08 to 0.12% of Nb, 0.02% or less of P, 0.002% or less of S, 0.05 to 0.3% of Cr, 0.4 to 0.9% of Ni, 0.3 to 0.5% of Mo, 0.05 to 0.3% of Cu, 0.0005 to 0.006% of Ca, 0.001 to 0.04% of V, and the balance of Fe and inevitable impurities.

Carbon (C): 0.03 to 0.065%

Carbon (C) is the most economical and effective element for strengthening steel. In the present disclosure, a lower limit of the carbon (C) content may be limited to 0.03% in terms of ensuring strength of the steel. However, an excessive addition of carbon (C) may lower weldability, formability and toughness of the steel, and thus, in the present disclosure, an upper limit of the carbon (C) content may be limited to 0.065%. Therefore, the carbon (C) content of the present disclosure may be in the range of 0.03 to 0.065%, and a more preferable carbon (C) content may be in the range of 0.04 to 0.065%.

Silicon (Si): 0.05 to 0.3%

Silicon (Si) is an element that acts as a deoxidizer and is an element that contributes to solid solution strengthening. In order to achieve such effects, in the present disclosure, a lower limit of the silicon (Si) content may be limited to 0.05%. However, an excessive addition of silicon (Si) may lower ductility of a steel sheet and a large amount of red scale due to silicon (Si) oxide may be formed on the hot-rolled steel sheet, thereby degrading surface quality, and thus, in the present disclosure, an upper limit of the silicon (Si) content may be limited to 0.3%. Therefore, the silicon (Si) content of the present disclosure may be in the range of 0.05 to 0.3%, and a more preferable silicon (Si) content may be in the range of 0.1 to 0.3%.

Manganese (Mn): 1.7 to 2.2%

Manganese (Mn) is an element that effectively contributes to solid solution strengthening of steel and must be added in a certain amount or more to effectively contribute to an effect of increasing hardenability and high strength. In order to achieve this effect, in the present disclosure, a lower limit of the manganese (Mn) content may be limited to 1.7 wt %. However, an excessive addition of manganese (Mn) may cause a segregation part to be concentratively formed at a center part during slab casting and lower weldability of steel, and thus, in the present disclosure, an upper limit of the manganese (Mn) content may be limited to 2.2%. Therefore, the manganese (Mn) content of the present disclosure may be in the range of 1.7 to 2.2%, and a more preferable manganese (Mn) content may be in the range of 1.8 to 2.1%.

Aluminum (Al): 0.01 to 0.04%

Aluminum (Al) is a representative element acting as a deoxidizer and is also an element contributing to solid solution strengthening. In order to achieve this effect, in the present disclosure, a lower limit of the aluminum (Al) content may be limited to 0.01%. However, an excessive addition of aluminum (Al) may lower a low-temperature impact toughness, and thus, in the present disclosure, an upper limit of the aluminum (Al) content may be limited to 0.04%. Therefore, the aluminum (Al) content of the present disclosure may be in the range of 0.01 to 0.04%, and a more preferable aluminum (Al) content may be in the range of 0.015 to 0.035%.

Titanium (Ti): 0.005 to 0.025%

Titanium (Ti) is a very useful element to refine a grain. Titanium (Ti) in steel is mostly combined with N to exist as TiN precipitates, and the TiN precipitates may act as a mechanism for suppressing austenite grain growth in a heating process for hot rolling. In addition, the titanium (Ti) remaining after reacting with nitrogen is combined with carbon (C) in the steel to form fine TiC precipitates, thus significantly increasing strength of the steel by the TiC fine precipitates. In order to achieve this effect, in the present disclosure, a lower limit of the titanium (Ti) content may be limited to 0.005%. Meanwhile, if titanium (Ti) is excessively added, a degradation of toughness of a welding heat affected portion by re-dissolving TiN precipitates is problematic, and thus, in the present disclosure, an upper limit of the titanium (Ti) content may be limited to 0.025%. Therefore, the titanium (Ti) content of the present disclosure may be in the range of 0.005 to 0.025%, and a more preferable titanium (Ti) content may be in the range of 0.01 to 0.025%.

Nitrogen (N): 0.008% or Less

In general, nitrogen (N) is known as an element dissolved in a steel and precipitated to increase strength of steel and the effect of contributing to the increase in strength is known to be significantly higher than that of carbon (C). However, an excessive increase in the nitrogen (N) content in the steel may significantly deteriorate toughness, and thus, it is a general trend to try to reduce the nitrogen (N) content as much as possible in a steelmaking process. However, in the present disclosure, TiN precipitates are formed to be used as a mechanism of suppressing growth of austenite grains in a reheating process, and since excessive cost is required to actively limit the nitrogen (N) content in the steelmaking process, an upper limit of the nitrogen (N) content is not actively limited. However, in the present disclosure, part of titanium (Ti) does not react with nitrogen (N) and should react with carbon (C) to form TiC precipitates, and thus, an upper limited of nitrogen (N) content may be limited to 0.008%, and a more preferable upper limit of the nitrogen (N) content may be 0.005%.

Niobium (Nb): 0.08 to 0.12%

Niobium (Nb) is an effective element for grain refinement and is an element that may significantly improve strength of steel. Therefore, in the present disclosure, a lower limit of the niobium (Nb) content may be limited to 0.08%. However, if the content of niobium (Nb) exceeds a certain range, toughness of the steel material may be lowered due to excessive precipitation of niobium (Nb) carbonitride, and thus, in the present disclosure, an upper limit of the content of niobium (Nb) may be limited to 0.12%. Therefore, the niobium (Nb) content of the present disclosure may be in the range of 0.08 to 0.12%, and a more preferable niobium (Nb) content may be in the range of 0.09 to 0.12%.

Phosphorus (P): 0.02% or Less

Phosphorus (P) is segregated at the center part of the steel sheet to provide a crack initiation point or a path for crack propagation, and thus, in order to prevent degradation of crack characteristics, the content of phosphorus (P) is preferably controlled as low as possible. To achieve the effect, the content of phosphorus (P) is preferably theoretically 0% but phosphorus (P) is an element inevitably contained in the steelmaking process, and since an excessive cost incurs to completely remove the content of phosphorus (P) in the steelmaking process, it is not economically and technically desirable to limit the content of phosphorus (P) to 0%. Therefore, in the present disclosure, the content of phosphorus (P) is positively limited but an upper limit thereof may be limited to 0.02% in consideration of the inevitably contained content, and a more preferred upper limit of the phosphorus (P) content may be 0.01%.

Sulfur (S): 0.002% or Less

Sulfur (S) is also an element inevitably contained in the steelmaking process and is also an element combined with manganese (Mn) or the like to form a non-metallic inclusion to significantly reduces toughness and strength of steel. Therefore, it is desirable to control the sulfur (S) content as low as possible, and thus, the sulfur (S) content of the present disclosure may be limited to 0.002% or less.

Chromium (Cr): 0.05 to 0.3%

In general, chromium (Cr) is known as an element that increases hardenability of steel when quenching and is known as an element that improves corrosion resistance and hydrogen cracking resistance of steel. In addition, chromium (Cr) is also an element capable of effectively ensuring good impact toughness because it suppresses formation of a pearlite structure. In order to achieve the effect, in the present disclosure, a lower limit of the chromium (Cr) content may be limited to 0.05%. However, an excessive addition of chromium (Cr) may cause cooling cracks after welding in the field and may deteriorate toughness of a heat affected portion, and thus, in the present disclosure, an upper limit of the chromium (Cr) content may be limited to 0.3%. Therefore, the chromium (Cr) content of the present disclosure may be in the range of 0.05 to 0.3%, and a more preferable chromium (Cr) content may be in the range of 0.08 to 0.2%.

Nickel (Ni): 0.4 to 0.9%

Nickel (Ni) is an element that stabilizes austenite and is an element that suppresses formation of pearlite. In addition, nickel (Ni) is an element that facilitates formation of acicular ferrite which is a low-temperature transformation structure. Therefore, in order to achieve such effects, in the present disclosure, a lower limit of the nickel (Ni) content may be limited to 0.4%. However, an excessive addition of nickel (Ni) may lower economical efficiency and deteriorate toughness of a welded portion, and thus, in the present disclosure, an upper limit of the nickel (Ni) content may be limited to 0.9%. Therefore, the nickel (Ni) content of the present disclosure may be in the range of 0.4 to 0.9%, and a more preferable nickel (Ni) content may be in the range of 0.46 to 0.8%.

Molybdenum (Mo): 0.3 to 0.5%

Molybdenum (Mo) is a very effective element to increase strength of the material and is an element to promote generation of acicular ferrite which is a low-temperature transformation structure to lower a yield ratio. In addition, since molybdenum (Mo) suppresses formation of a pearlite structure, molybdenum (Mo) may ensure good impact toughness and effectively preventing a reduction in a yield strength after pipe forming. In order to achieve the effects, in present disclosure, a lower limit of the molybdenum (Mo) content may be limited to 0.3%. However, an excessive addition of molybdenum (Mo) may deteriorate toughness due to the occurrence of low temperature cracks in the welding and formation of low-temperature transformation phase and is not desirable in terms of production cost, and thus, in the present disclosure, an upper limit of the molybdenum (Mo) content may be limited to 0.5%. Therefore, the molybdenum (Mo) content of the present disclosure may be in the range of 0.3 to 0.5%, and a more preferable molybdenum (Mo) content may be in the range of 0.3 to 0.45%.

Copper (Cu): 0.05 to 0.3%

Copper (Cu) is an element dissolved in the steel to increase strength. In order to achieve the effect, in the present disclosure, a lower limit of the copper (Cu) content may be limited to 0.05%. Meanwhile, an excessive addition of copper (Cu) may increase a possibility of occurrence of cracks during casting, and thus, in the present disclosure, an upper limit of the copper (Cu) content may be limited to 0.3%. Therefore, the copper (Cu) content of the present disclosure may be in the range of 0.05 to 0.3%, and a more preferable copper (Cu) content may be in the range of 0.1 to 0.25%.

Calcium (Ca): 0.0005 to 0.006%

Calcium (Ca) is an element useful for a non-metallic inclusion such as MnS and is an element having excellent capability to suppress crack formation around the non-metallic inclusion such as MnS. In order to achieve such effects, in the present disclosure, a lower limit of the calcium (Ca) content may be limited to 0.0005%. Meanwhile, an excessive addition of calcium (Ca) may rather produce a large amount of CaO-based inclusions to lower impact toughness, and thus, in the present disclosure, an upper limit of the calcium (Ca) content may be limited to 0.006%. Therefore, the calcium (Ca) content of the present disclosure may be in the range of 0.0005 to 0.006%, and a more preferable calcium (Ca) content may be in the range of 0.001 to 0.005%.

Vanadium (V): 0.001 to 0.04%

An addition of vanadium (V) may obtain an effect similar to the addition of niobium (Nb) but the effect is not match for the addition of niobium (Nb). However, addition of vanadium (V) together with niobium (Nb) may obtain a remarkable effect compared to the addition of vanadium (V) alone and obtain a remarkable effect particularly in increasing strength of the steel. In order to obtain the effect of increasing strength of the steel, in the present disclosure, a lower limit of the vanadium (V) content may be limited to 0.001%. However, an excessive addition of vanadium (V) may deteriorate toughness of the steel material due to an excessive formation of vanadium (V) carbonitride, and in particular, toughness of a welding heat affected portion may deteriorate, and thus, an upper limit of the vanadium (V) content may be limited to 0.04%. Therefore, the vanadium (V) content of the present disclosure may be in the range of 0.001 to 0.04%, and a more preferred vanadium (V) content may be in the range of 0.01 to 0.04%.

Hereinafter, equations of the present disclosure will be described in detail.

The steel material for a low yield ratio, high-strength steel pipe having excellent low-temperature toughness according to an aspect of the present disclosure may satisfy one or more of Equations 1, 2, and 3 below.

$$0.17 \le [\{Ti-0.8*(48/14)N\}/48+\{Nb-0.8*(93/14)N\}/93]/(C/12) \le 0.25 \quad \text{[Equation 1]}$$

C, Ti, Nb and N of Equation 1 refer to the content of C, Ti, Nb and N, respectively.

$$2 \le Cr+3*Mo+2*Ni \le 2.7 \quad \text{[Equation 2]}$$

Cr, Mo and Ni of Equation 2 refer to the content of Cr, Mo and Ni, respectively.

$$100*(P+10*S) \le 2.4 \quad \text{[Equation 3]}$$

P and S of Equation 3 refer to the content of P and S, respectively.

$$0.17 \le [\{Ti-0.8*(48/14)N\}/48+\{Nb-0.8*(93/14)N\}/93]/(C/12) \le 0.25 \quad \text{[Equation 1]}$$

C, Ti, Nb, and N of Equation 1 refer to the content of C, Ti, Nb, and N, respectively.

Hereinafter, the reason for controlling components through each equation will be described.

Equation 1 refers to conditions for securing fine TiC, NbC, and (Ti, Nb)C precipitates. {Ti-0.8*(48/14)N} in Equation 1 refers to the content of titanium (Ti) that remains after reacting with nitrogen (N) in the total titanium (Ti) content added to the steel and reacts with carbon (C), and {Nb-0.8*(93/14)N} in Equation 1 refers to the content of niobium (Nb) that remains after reacting with nitrogen (N) in the total niobium (Nb) content added to the steel and reacts with carbon (C). If the value calculated by Equation 1 is less than 0.17, effective TiC, NbC, and (Ti, Nb)C precipitates are not precipitated, and if the value calculated by Equation 1 exceeds 0.25, the TiC, NbC, and (Ti, Nb)C precipitates become coarse, which is not preferable in terms of ensuring strength. Therefore, the value calculated by Equation 1 of the present disclosure may be limited to the range of 0.17 to 0.25.

$$2 \le Cr+3*Mo+2*Ni \le 2.7 \quad \text{[Equation 2]}$$

Cr, Mo, and Ni in Equation 2 refer to the content of Cr, Mo, and Ni, respectively.

Equation 2 is conditions for obtaining fine acicular ferrite. If the value calculated by Equation 2 is less than 2, hardenability of the steel material is so small that a polygonal ferrite is formed, reducing a fraction of acicular ferrite decreases, and thus it may be difficult to ensure sufficient strength of the steel material. Meanwhile, if the value calculated by Equation 2 exceeds 2.7, impact toughness of the steel may become inferior due to the occurrence of separation. Therefore, the value calculated by Equation 1 of the present disclosure may be limited to the range of 2 to 2.7.

$$100*(P+10*S) \le 2.4 \quad \text{[Equation 3]}$$

P and S in Equation 3 refer to the content of P and S, respectively.

Equation 3 is a condition for preventing segregation of phosphorus (P) and sulfur (S) in internal cracks of a slab during continuous casting of the slab. If the value calculated by Equation 3 exceeds 2.4, phosphorus (P) and sulfur (S) are segregated in the internal cracks of the slab to provide a starting point for the occurrence of cracks during an impact test, making it impossible to sufficiently ensure impact toughness of the steel material. Therefore, the value calculated by Equation 3 of the present disclosure may be limited to 2.4 or less.

Hereinafter, a microstructure of the present disclosure will be described in detail.

The steel material for a low yield ratio, high-strength steel pipe having excellent low temperature toughness according to an aspect of the present disclosure may include acicular ferrite, bainitic ferrite, granular bainite, and martensite-austenite (MA) as a microstructure, and these acicular ferrite, bainitic ferrite, granular bainite, and island martensite may be included in an area fraction of 80 to 90%, 4 to 12%, 6% or less, and 5% or less, respectively.

In addition, the steel material for a low yield ratio, high-strength steel pipe having excellent low temperature toughness according to an aspect of the present disclosure may include acicular ferrite, bainitic ferrite, granular bainite, and martensite-austenite (MA) as microstructures, and these acicular ferrites, bainitic ferrite, granular bainite, and island martensite may have an average effective grain size of 15 μm or less, 20 μm or less, 20 μm or less, 3 μm or less, respectively. Here, the average effective grain size refers to a value measured based on a case in which misorientation of grains is 15 degrees or greater using electron back scatter diffraction (EBSD).

In addition, in the steel material for a low yield ratio, high-strength steel pipe having excellent low temperature toughness according to an aspect of the present disclosure, the number of precipitates having an average diameter of 20 nm or less may be 6.5*109 pieces/$mm^2$ or more per unit area based on a steel cross-section, and the precipitates may include TiC, NbC, and (Ti, Nb)C precipitates.

The steel material for a low yield ratio, high-strength steel pipe having excellent low temperature toughness according to an aspect of the present disclosure, which satisfies the alloy composition, conditions, and microstructure described above, may have a yield strength of 540 MPa or more in a 30° inclined direction with reference to a rolling direction. As the yield strength of the 30° inclined direction with reference to the rolling direction, generally, the lowest yield strength may be measured in a yield strength measurement test of steel materials.

In addition, the steel material for a low yield ratio, high-strength steel pipe having excellent low temperature toughness according to an aspect of the present disclosure may satisfy a tensile strength of 670 MPa or more, 190 J or more of Charpy impact energy at −60° C., and the lowest temperature satisfying 85% or more of DWTT shear area of −18° C. or lower, a yield ratio of less than 85%, and an elongation percentage of 39% or more.

Hereinafter, a manufacturing method of the present disclosure will be described in detail.

A steel material for low yield ratio, high-strength steel having excellent low-temperature toughness may be manufactured by: reheating a slab including, by wt %, 0.03 to 0.065% of C, 0.05 to 0.3% of Si, 1.7 to 2.2% of Mn, 0.01 to 0.04% of Al, 0.005 to 0.025% of Ti, 0.008% or less of N, 0.08 to 0.12% of Nb, 0.02% or less of P, 0.002% or less of S, 0.05 to 0.3% of Cr, 0.4 to 0.9% of Ni, 0.3 to 0.5% of Mo, 0.05 to 0.3% of Cu, 0.0005 to 0.006% of Ca, 0.001 to 0.04% of V, and the balance of Fe and inevitable impurities, and satisfying one or more of Equation 1, Equation 2, and Equation 3 below; rolling the reheated slab in a recrystallization region; primarily cooling the recrystallized rolled steel material; rolling the primarily cooled steel material in a non-recrystallization region at a non-recrystallization region temperature; secondarily cooling the steel material rolled in the non-recrystallization region; and coiling the second cooled steel material to manufacture the same.

$$0.17 \le [\{Ti-0.8*(48/14)N\}/48+\{Nb-0.8*(93/14)N\}/93]/(C/12) \le 0.25 \quad \text{[Equation 1]}$$

C, Ti, Nb, and N in Equation 1 refer to content of C, Ti, Nb, and N, respectively.

$$2 \le Cr+3*Mo+2*Ni \le 2.7 \quad \text{[Equation 2]}$$

Cr, Mo, and Ni in the Equation 2 refer to content of Cr, Mo, and Ni, respectively.

$$100*(P+10*S) \le 2.4 \quad \text{[Equation 3]}$$

P and S in Equation 3 refer to content of P and S, respectively.

Since the slab alloy composition of the present disclosure corresponds to the alloy composition of the steel material described above, the description of the slab alloy composition of the present disclosure will be replaced by the description of the alloy composition of the steel material described above. In addition, since the equations related to the slabs of the present disclosure also correspond to the equations related to the steel materials, the description of the equations related to the slabs of the present disclosure will also be replaced by the description of the equations related to the steel materials described above.

Slab Reheating

The slab provided with the composition and conditions described above are reheated in a temperature range of 1080 to 1180° C. If the slab reheating temperature is lower than 1080° C., the additive alloy elements precipitated in a continuous casting process cannot be sufficiently re-dissolved, and the amount of formation of precipitates such as TiC, NbC, and (Ti, Nb)C in a process after hot rolling is reduced. Therefore, by maintaining the reheating temperature at 1080° C. or higher, the atmosphere for re-dissolving precipitates may be promoted and a moderate austenite grain size may be maintained to improve a strength level of the material and secure a uniform microstructure along a length direction of a coil. Meanwhile, if the reheating temperature is too high, the strength of the steel decreases due to abnormal grain growth of austenite grains, and thus, an upper limit of the reheating temperature may be limited to 1180° C.

Maintaining and Extraction

The reheated slab may be maintained for at least 45 minutes in a temperature range of 1140° C. or higher, and then extracted and provided in hot rolling. If a slab maintain temperature is lower than 1140° C., workability of hot rolling such as the rolling properties of hot rolling or the like may be lowered, and thus, the maintain temperature of the slab may be limited to 1140° C. or higher. In addition, if a holding time is less than 45 minutes, uniformity of heat temperature of the slab in a thickness direction and a length direction is low to lower rolling properties and cause a variation in physical properties of a final steel sheet. Therefore, it is preferable that the slab is maintained for as long as possible, but it is preferably maintained for 90 minutes or less in consideration of productivity and economical efficiency. Therefore, the holding time of the present disclosure may be limited to 45 to 90 minutes.

Primary Rolling and Primary Cooling

Primary rolling is performed on the maintained and extracted slab, and the primary rolling may be terminated in a temperature range of 980 to 1100° C. This is because, if the temperature of the primary rolling is lower than 980° C., recrystallization may not occur, and if the temperature of the primary rolling exceeds 1100° C., the size of the recrystallized grains may become excessively coarse to deteriorate toughness. Rolling and recrystallization are repeated by the primary rolling and the austenite may partially be microstructured.

After the primary rolling, the primarily rolled steel material may be cooled at a cooling rate of 20 to 60° C./s. A cooling method of the primary cooling is not particularly limited but the primary cooling method of the present disclosure may be water cooling. If the cooling rate of the primary cooling is less than 20° C./s, uniformity of heat temperature of the primarily rolled steel material in the thickness direction may be low to cause variation in physical properties of a final steel sheet. In particular, since a temperature reduction at a center part of the primarily rolled steel material is insufficient, a low temperature rolling effect at the recrystallization region temperature cannot be sufficiently expected, and coarse bainite is formed at the center of the final steel material to deteriorate the DWTT characteristics. Meanwhile, due to the characteristics of the facility, the primary cooling rate cannot exceed 60° C. Therefore, the primary cooling rate of the present disclosure may be limited to 20 to 60° C./s. In addition, the primary cooling may be performed until a temperature of the primarily rolled steel reaches a non-recrystallization region temperature, which will be described later.

Secondary Rolling

Secondary rolling may be performed on the primarily cooled steel material at the non-recrystallization region temperature of 910 to 970° C. and the secondary rolling may be terminated in a temperature range of Ar3+70° C. to Ar3+110° C. Here, the Ar3 temperature refers to a temperature at which austenite is transformed into ferrite, which may be theoretically calculated by Equation 1 below.

$$Ar3(^\circ C.)=910-(310*C)-(80*Mn)-(55*Ni)-(15*Cr)-(80*Mo)-(20*Cu)+(0.35*(t-8)) \quad \text{[Equation 1]}$$

In Equation 1 above, C, Mn, Ni, Cr, Mo, and Cu refer to the content of each component, and t refers to a thickness of the steel material.

If the secondary rolling termination temperature exceeds Ar3+110° C., a coarse transformation structure may be formed, and if the secondary rolling termination temperature is lower than Ar3+70° C., strength and a yield ratio of the final steel material may be inferior. Therefore, the secondary rolling termination temperature of the present disclosure may be limited to the range of Ar3+70° C. to Ar3+110° C.

In addition, a cumulative reduction ratio of the secondary rolling may be 75 to 85%. If the cumulative reduction ratio of the secondary rolling is less than 75%, austenite crystals are not sufficiently reduced and a fine transformation structure cannot be obtained. In addition, an excessive cumulative reduction ratio of the secondary rolling may cause an excessive load on the rolling facility, and thus an upper limit of the cumulative reduction ratio of the secondary rolling may be limited to 85%. Therefore, the cumulative reduction rate of the secondary rolling of the present disclosure may be 75 to 85%.

Secondary Cooling

The secondarily rolled steel material may be cooled to a coiling temperature at a cooling rate of 10 to 40° C./s. A cooling method of the secondary cooling is not particularly limited, but the secondary cooling method of the present disclosure may be water cooling and may be performed on a run-out table. If the cooling rate of the secondary cooling is less than 10° C./sec, an average size of precipitates may exceed 0.2 μm and the number of precipitates having an average diameter of 20 nm or less in a cross section of the final steel may be $6.5*10^9/mm^2$ or less per unit area. This is because, as the cooling rate is higher, a large amount of nuclei may be generated and the precipitates may become fine, while as the cooling rate is lower, a probability that a small amount of nuclei may be generated and the precipitates may become coarse. As the cooling rate of the secondary cooling is higher, the size of the precipitates of the final steel material may become finer, so there is no need to specifically limit an upper limit of the cooling rate of the secondary cooling. However, even if the cooling rate of the secondary cooling is higher than 40° C./s, the effect of miniaturization of the precipitates does not increase in proportion to the cooling rate, and thus the upper limit of the cooling rate of the secondary cooling may be limited to 40° C./s. Therefore, the secondary cooling rate of the present disclosure may be 10 to 40° C./s.

Coiling

The secondary cooling-completed steel material may be coiled in a temperature range of 420 to 540° C. If a coiling temperature exceeds 540° C., an acicular ferrite fraction decreases, an island martensite fraction increases, and the precipitates grow coarsely, making it difficult to ensure strength and low-temperature toughness. Meanwhile, if the coiling temperature is lower than 420° C., a hard phase such as martensite may be formed to lower impact characteristics.

MODE FOR INVENTION

Hereinafter, the present disclosure will be described in detail through examples. However, it is necessary to note that the exemplary embodiments described below are only intended to further illustrate the present disclosure and are not intended to limit the scope of the present disclosure.

After manufacturing a steel slab provided with the alloy compositions and conditions of Table 1 and Table 2 below, the steel slab was rolled under the manufacturing conditions of Table 3 to manufacture a hot rolled steel sheet having a thickness of 23.7 mm.

TABLE 1

| Steel type | C | Mn | Si | Nb | Ti | V | Cr | Mo | Ni | Cu | Al | P | S | N | Ca |
|---|---|---|---|---|---|---|---|---|---|---|---|---|---|---|---|
| A1 | 0.056 | 1.82 | 0.27 | 0.1 | 0.015 | 0.023 | 0.17 | 0.3 | 0.46 | 0.2 | 0.03 | 0.0078 | 0.0015 | 0.0047 | 0.002 |
| A2 | 0.045 | 1.95 | 0.3 | 0.092 | 0.012 | 0.025 | 0.08 | 0.35 | 0.75 | 0.2 | 0.025 | 0.0081 | 0.0012 | 0.0031 | 0.003 |
| A3 | 0.052 | 2 | 0.3 | 0.098 | 0.017 | 0.03 | 0.15 | 0.38 | 0.55 | 0.25 | 0.031 | 0.0082 | 0.0013 | 0.0038 | 0.0031 |
| A4 | 0.061 | 1.94 | 0.25 | 0.11 | 0.018 | 0.035 | 0.18 | 0.41 | 0.52 | 0.18 | 0.034 | 0.0079 | 0.0014 | 0.0043 | 0.0025 |
| A5 | 0.058 | 1.98 | 0.27 | 0.09 | 0.021 | 0.038 | 0.19 | 0.37 | 0.51 | 0.19 | 0.029 | 0.0085 | 0.0008 | 0.0029 | 0.0025 |

TABLE 1-continued

| Steel type | C | Mn | Si | Nb | Ti | V | Cr | Mo | Ni | Cu | Al | P | S | N | Ca |
|---|---|---|---|---|---|---|---|---|---|---|---|---|---|---|---|
| B1 | 0.068 | 1.9 | 0.3 | 0.08 | 0.01 | 0.025 | 0.1 | 0.25 | 0.4 | 0.2 | 0.031 | 0.015 | 0.0019 | 0.0031 | 0.0032 |
| B2 | 0.055 | 1.8 | 0.23 | 0.08 | 0.009 | 0.03 | 0.15 | 0.31 | 0.42 | 0.15 | 0.035 | 0.015 | 0.0012 | 0.003 | 0.0028 |
| B3 | 0.075 | 1.7 | 0.22 | 0.092 | 0.01 | 0.02 | 0.13 | 0.32 | 0.4 | 0.2 | 0.032 | 0.021 | 0.0014 | 0.0038 | 0.0031 |
| B4 | 0.06 | 2.1 | 0.3 | 0.12 | 0.022 | 0.024 | 0.12 | 0.3 | 0.45 | 0.12 | 0.003 | 0.011 | 0.0015 | 0.001 | 0.0025 |
| B5 | 0.045 | 1.8 | 0.26 | 0.11 | 0.023 | 0.023 | 0.14 | 0.5 | 0.7 | 0.22 | 0.003 | 0.015 | 0.0016 | 0.003 | 0.0029 |

TABLE 2

| Steel type | Equation 1 | Equation 2 | Equation 3 |
|---|---|---|---|
| A1 | 0.18 | 2.0 | 2.3 |
| A2 | 0.24 | 2.6 | 2.0 |
| A3 | 0.22 | 2.4 | 2.1 |
| A4 | 0.21 | 2.5 | 2.2 |
| A5 | 0.22 | 2.3 | 1.7 |
| B1 | 0.13 | 1.7 | 3.4 |
| B2 | 0.15 | 1.9 | 2.8 |
| B3 | 0.12 | 1.9 | 3.5 |
| B4 | 0.26 | 1.9 | 2.6 |
| B5 | 0.35 | 3.0 | 3.1 |

TABLE 3

| Remark | Steel type | Reheating temperature (° C.) | Holding time at 1140° C. or higher (min) | Primary rolling termination temperature (° C.) | Primary cooling rate (° C./s) | Second rolling starting temperature (° C.) | Second rolling termination temperature (° C.) | Second rolling accumulated reduction ratio (%) | Theoretical Ar3 (° C.) | Second cooling rate (° C./s) | Coiling temperature (° C.) |
|---|---|---|---|---|---|---|---|---|---|---|---|
| IM* | A1 | 1148 | 71 | 1081 | 23 | 950 | 780 | 79 | 697 | 12 | 446 |
| | A2 | 1145 | 62 | 1092 | 24 | 943 | 773 | 80 | 671 | 14 | 522 |
| | A3 | 1147 | 82 | 1079 | 22 | 938 | 763 | 80 | 671 | 12 | 426 |
| | A4 | 1157 | 85 | 1065 | 25 | 941 | 771 | 81 | 674 | 15 | 489 |
| | A5 | 1146 | 81 | 1068 | 26 | 948 | 771 | 79 | 675 | 14 | 516 |
| CM** | B1 | 1198 | 43 | 1123 | Not performed | 970 | 790 | 77 | 695 | 14 | 562 |
| | B2 | 1146 | 66 | 1086 | 22 | 942 | 765 | 80 | 701 | 16 | 476 |
| | B3 | 1151 | 65 | 1080 | 21 | 954 | 774 | 79 | 703 | 12 | 478 |
| | B4 | 1153 | 58 | 1086 | 25 | 949 | 781 | 80 | 676 | 15 | 456 |
| | B5 | 1201 | 42 | 1132 | Not performed | 982 | 799 | 75 | 673 | 7 | 523 |
| | A1 | 1210 | 44 | 1135 | Not performed | 981 | 801 | 74 | 697 | 8 | 522 |
| | A2 | 1206 | 41 | 1121 | Not performed | 972 | 802 | 76 | 671 | 10 | 546 |

*IM: Inventive material

**CM: Comparative material

Table 4 is a result of observing a microstructure of the hot-rolled steel sheet specimen manufactured by Table 3, and Table 5 is a result of measuring physical properties of the hot-rolled steel sheet specimen manufactured by Table 3. Vernier grains and the area fractions of the acicular ferrite, bainitic ferrite, and granular ferrite were measured using EBSD, and the area fraction of island martensite was measured by applying the Lepera etching method. Yield strength, tensile strength, yield ratio, total elongation percentage, and DWTT shear area were measured by applying API tensile test method and DWTT test method, and impact energy was measured using an ASTM A370 test piece.

TABLE 4

| Remark | Steel type | Acicular ferrite fraction (%)/ average effective crystal gran size (μm) | Bainitic ferrite fraction (%)/ average effective crystal gran size (μm) | Island martensite fraction (%)/ average effective crystal gran size (μm) | Granular bainite fraction (%)/ average effective crystal gran size (μm) | Number of precipitates of 20 nm or less per unit area (number/mm$^2$) |
|---|---|---|---|---|---|---|
| *IM | A1 | 86/14 | 5/17 | 3/1 | 6/15 | $7.2 \times 10^9$ |
| | A2 | 85/13 | 6.7/15 | 4/2 | 4.3/14 | $8.8 \times 10^9$ |
| | A3 | 86/14 | 7/14 | 1/2 | 6/16 | $9.4 \times 10^9$ |
| | A4 | 86/14 | 7/16 | 2/1 | 5/15 | $8.9 \times 10^9$ |
| | A5 | 85/12 | 12/14 | 2/2 | 1/13 | $8.3 \times 10^9$ |
| **CM | B1 | 75/21 | 2/22 | 7/4 | 16/23 | $6.3 \times 10^9$ |
| | B2 | 81/25 | 2/17 | 4/2 | 13/19 | $4.8 \times 10^9$ |
| | B3 | 82/17 | 3/18 | 2/1 | 13/18 | $5.2 \times 10^9$ |
| | B4 | 80/13 | 3/15 | 3/2 | 14/17 | $5.8 \times 10^9$ |
| | B5 | 82/23 | 2/22 | 4/3 | 12/25 | $6.1 \times 10^9$ |
| | A1 | 83/26 | 1/21 | 7/4 | 9/24 | $5.2 \times 10^9$ |
| | A2 | 80/28 | 1/23 | 8/6 | 11/38 | $5.8 \times 10^9$ |

*IM: Inventive material
**CM: Comparative material

TABLE 5

| Remark | Steel type | Yield strength at 30° in rolling direction (MPa) | Tensile strength (MPa) | Yield ratio (tensile strength/ yield strength) | Total elongation percent age (%) | Impact energy (J, @ −60° C.) | Lowest temperature that satisfies 80% or more of DWTT shear area (° C.) |
|---|---|---|---|---|---|---|---|
| *IM | A1 | 582 | 708 | 82 | 42 | 230 | −20 |
| | A2 | 558 | 718 | 78 | 41 | 255 | −19 |
| | A3 | 566 | 701 | 81 | 43 | 238 | −21 |
| | A4 | 574 | 720 | 80 | 42 | 243 | −18 |
| | A5 | 588 | 710 | 83 | 41 | 261 | −20 |
| **CM | B1 | 543 | 648 | 84 | 36 | 145 | −5 |
| | B2 | 543 | 655 | 83 | 38 | 189 | −7 |
| | B3 | 542 | 651 | 83 | 39 | 184 | −10 |
| | B4 | 551 | 648 | 85 | 37 | 187 | −9 |
| | B5 | 547 | 648 | 84 | 38 | 165 | −3 |
| | A1 | 542 | 643 | 84 | 37 | 185 | −11 |
| | A2 | 542 | 649 | 84 | 38 | 183 | −12 |

*IM: Inventive material

**CM: Comparative material

As shown in Table 4 and Table 5, it can be seen that, in the case of an inventive material that satisfies the alloy compositions, conditions and process conditions of the present disclosure, acicular ferrite, bainitic ferrite, granular bainite, and island martensite are included as microstructures, the area fractions thereof satisfy 80 to 90%, 4 to 12%, 6% or less, and 5% or less, respectively, and average effective grain sizes thereof satisfy 15 μm or less, 20 μm or less, 20 μm or less, and 3 μm or less, respectively. In addition, it can be seen that, in the case of the inventive material, the number of precipitates having an average diameter of 20 nm or less is $6.5*10^9/mm^2$ or more per unit area based on a cross-section of the steel material.

In addition, in the case of the inventive material that satisfies the alloy compositions, conditions, and process conditions of the present disclosure, the steel material satisfying the conditions that the yield strength in the 30° inclined direction with reference to the rolling direction is 540 MPa or greater, the tensile strength is 670 MPa or greater, Charpy impact energy is 190 J or greater at −60° C., a lowest temperature satisfying DWTT shear area of 85% or greater is −18° C. or lower, a yield ratio is less than 85%, an elongation percentage is 39% or greater, and a manufacturing method therefor may be provided.

Meanwhile, in the case of the comparative examples that do not satisfy the alloy compositions, conditions, or process conditions of the present disclosure, it can be seen that all of the microstructures and physical properties described above are not satisfied.

Therefore, it can be seen that the steel material for a steel pipe and the manufacturing method therefor according to an exemplary embodiment in the present disclosure satisfy all of the characteristics of excellent low-temperature toughness, high strength, and low yield ratio.

The present disclosure has been described in detail through exemplary embodiments above, but other types of exemplary embodiments are also possible. Therefore, the technical spirit and scope of the claims set forth below are not limited to the exemplary embodiments.

The invention claimed is:

1. A steel material comprising, by wt %, 0.03 to 0.065% of C, 0.05 to 0.3% of Si, 1.7 to 2.2% of Mn, 0.01 to 0.04% of Al, 0.005 to 0.025% of Ti, 0.008% or less of N, 0.08 to 0.12% of Nb, 0.02% or less of P, 0.002% or less of S, 0.05 to 0.3% of Cr, 0.4 to 0.9% of Ni, 0.3 to 0.5% of Mo, 0.05 to 0.3% of Cu, 0.0005 to 0.006% of Ca, 0.001 to 0.04% of V, and a balance of Fe and inevitable impurities, wherein the number of precipitates having an average diameter of 20 nm or less per unit area in a cross section of the steel material is $6.5*10^9/mm^2$ or greater, wherein the steel material comprises acicular ferrite of 80 to 90%, bainitic ferrite of 4 to 12%, granular bainite of 6% or less, and martensite-austenite (MA) of 5% or less, by an area fraction as a microstructure, and wherein the steel material satisfies Equation 1 below:

$$0.17 \le [\{Ti-0.8*(48/14)N\}/48+\{Nb-0.8*(93/14)N\}/93]/(C/12) \le 0.25 \quad \text{[Equation 1]}$$

wherein C, Ti, Nb, and N refer to contents of C, Ti, Nb and N, respectively.

2. The steel material of claim 1, wherein the precipitates include TiC, NbC and (Ti, Nb)C precipitates.

3. The steel material of claim 1, wherein the steel material satisfies Equation 2 below:

$$2 \le Cr+3*Mo+2*Ni \le 2.7 \quad \text{[Equation 2]}$$

wherein Cr, Mo and Ni refer to contents of Cr, Mo and Ni, respectively.

4. The steel material of claim 1, wherein an average effective grain size of the acicular ferrite is 15 μm or less, an average effective grain size of the bainitic ferrite is 20 μm or less, an average effective grain size of the granular bainite is 20 μm or less, and an average effective grain size of the martensite-austenite is 3 μm or less.

5. The steel material of claim 1, wherein the steel material satisfies Equation 3 below:

$$100*(P+10*S) \le 2.4 \quad \text{[Equation 3]}$$

wherein P and S refer to contents of P and S, respectively.

6. The steel material of claim 1, wherein an yield strength of the steel material in a 30° inclined direction with reference to a rolling direction of the steel material is 540 MPa or greater, and a tensile strength of the steel material is 670 MPa or greater.

7. The steel material of claim 1, wherein an yield ratio of the steel material is less than 85% and an elongation percentage of the steel material is 39% or greater.

8. The steel material of claim 1, wherein the steel material has a Charpy impact energy of 190 J or greater at −60° C., and a lowest temperature satisfying drop weight tear test (DWTT) shear area of 85% or greater is −18° C. or lower.

9. The steel material of claim 1, wherein a thickness of the steel material is 23 mm or greater.

10. A method for manufacturing the steel material according to claim 1, the method comprising:

reheating a slab including, by wt %, 0.03 to 0.065% of C, 0.05 to 0.3% of Si, 1.7 to 2.2% of Mn, 0.01 to 0.04% of Al, 0.005 to 0.025% of Ti, 0.008% or less of N, 0.08 to 0.12% of Nb, 0.02% or less of P, 0.002% or less of S, 0.05 to 0.3% of Cr, 0.4 to 0.9% of Ni, 0.3 to 0.5% of Mo, 0.05 to 0.3% of Cu, 0.0005 to 0.006% of Ca, 0.001 to 0.04% of V, and the balance of Fe and inevitable impurities, and satisfying Equation 1, in a temperature range of 1080 to 1180° C.;

maintaining the reheated slab at a temperature of 1140° C. or higher for 45 minutes and extracting the slab;

primarily rolling the extracted slab at a rolling termination temperature of 980 to 1100° C.;

primarily cooling the primarily rolled steel material to a non-recrystallization region temperature range at a cooling rate of 20 to 60° C./s;

secondarily rolling the primarily cooled steel material primarily cooled at the non-recrystallization region temperature;

secondarily cooling the second rolled steel material at a cooling rate of 10 to 40° C./s; and coiling the second cooled steel material in a temperature range of 420 to 540° C. to to thereby manufacture the steel material of claim 1.

11. The method of claim 10, wherein the slab satisfies Equation 2 below:

$$2 \le Cr+3*Mo+2*Ni \le 2.7 \quad \text{[Equation 2]}$$

wherein Cr, Mo, and Ni refer to contents of Cr, Mo and Ni, respectively.

12. The method of claim 10, wherein the slab satisfies Equation 3 below $$100*(P+10*S) \le 2.4 \quad \text{[Equation 3]}$$

wherein P and S refer to contents of P and S, respectively.

13. The method of claim 10, wherein the non-recrystallization region temperature may be a temperature range of 910 to 970° C.

14. The method of claim 10, wherein a reduction ratio of the second rolling is 75 to 85%.

15. The method of claim 10, wherein a termination temperature of the second rolling is Ar3+70° C. to Ar3+110° C.

* * * * *